US008297723B2

(12) United States Patent
Chen et al.

(10) Patent No.: US 8,297,723 B2
(45) Date of Patent: Oct. 30, 2012

(54) INTERLOCK DEVICE FOR SLIDE ASSEMBLY

(75) Inventors: Ken-Ching Chen, Kaohsiung Hsien (TW); Hsueh-Lung Liu, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 99 days.

(21) Appl. No.: 13/010,978

(22) Filed: Jan. 21, 2011

(65) Prior Publication Data

US 2012/0187816 A1 Jul. 26, 2012

(51) Int. Cl.
*A47B 95/00* (2006.01)

(52) U.S. Cl. ..... 312/333; 312/221

(58) Field of Classification Search ..... 312/333, 312/319.1, 334.44, 334.46–334.47; 384/21
See application file for complete search history.

(56) References Cited

U.S. PATENT DOCUMENTS

| | | | | |
|---|---|---|---|---|
| 6,082,839 | A | 7/2000 | Chiku | |
| 6,109,708 | A | 8/2000 | Walla et al. | |
| 6,568,771 | B2 | 5/2003 | Gentili et al. | |
| 6,634,726 | B1 | 10/2003 | Slivon | |
| 6,637,843 | B2 | 10/2003 | Westwinkel | |
| 6,722,749 | B1 | 4/2004 | Pagac | |
| 6,726,294 | B1 | 4/2004 | Muller et al. | |
| 6,742,854 | B2 | 6/2004 | Chen | |
| 6,749,274 | B2 | 6/2004 | Westwinkel | |
| 6,779,855 | B2 | 8/2004 | Hoffman | |
| 6,896,342 | B1 | 5/2005 | Cheng | |
| 6,966,619 | B2 | 11/2005 | Muller | |
| 7,140,700 | B2 | 11/2006 | Dube et al. | |
| 7,144,092 | B1 | 12/2006 | Chang | |
| 7,293,845 | B2 | 11/2007 | Hoffman | |
| 7,320,507 | B2 | 1/2008 | White et al. | |
| 7,374,261 | B1 * | 5/2008 | Wang | 312/333 |
| 7,465,000 | B2 * | 12/2008 | Huang | 312/333 |
| 7,467,833 | B2 | 12/2008 | Weng | |
| 7,484,817 | B2 | 2/2009 | Hoffman et al. | |
| 7,520,576 | B2 | 4/2009 | Ludwig et al. | |
| 7,758,134 | B2 * | 7/2010 | Huang | 312/334.47 |
| 7,815,267 | B1 * | 10/2010 | Frousiakis | 312/333 |
| 7,823,992 | B2 | 11/2010 | Chen et al. | |
| 7,878,606 | B2 * | 2/2011 | Chen et al. | 312/333 |
| 7,914,093 | B2 * | 3/2011 | Huang | 312/333 |
| 8,079,653 | B2 * | 12/2011 | Huang | 312/333 |
| 8,083,304 | B2 * | 12/2011 | Hu | 312/333 |
| 8,132,873 | B2 * | 3/2012 | Yang | 312/333 |
| 2004/0227438 | A1 * | 11/2004 | Tseng et al. | 312/333 |
| 2007/0001562 | A1 * | 1/2007 | Park | 312/333 |
| 2007/0182292 | A1 * | 8/2007 | Huang | 312/221 |
| 2010/0164340 | A1 * | 7/2010 | Juan et al. | 312/333 |

* cited by examiner

*Primary Examiner* — Hanh V Tran
(74) *Attorney, Agent, or Firm* — Rosenberg, Klein & Lee

(57) ABSTRACT

An interlock device includes an outer rail, an inner rail, an intermediate rail, a base, a driving member, a stop and a locking member. The base is connected to one end of the outer rail and includes a top room and a bottom room. The driving member is movable and includes a driving portion, an engaging portion and a co-moving portion. The driving portion is located in the top room and partially exposed from the top room. The engaging portion is located in the bottom room. The stop is connected to the inner rail or the intermediate rail. The locking member is connected to the co-moving portion. When the inner rail and the intermediate rail are pulled out, the driving portion is pushed by the intermediate rail and retracted into the top room. The co-moving portion is moved to shift the locking member, and the engaging portion extends from the bottom room of the base.

9 Claims, 8 Drawing Sheets

INTERLOCK DEVICE FOR SLIDE ASSEMBLY

FIELD OF THE INVENTION

The present invention relates to an interlock device for a slide assembly, and more particularly, to an interlock device used for cabinet or rack, when multiple drawers are connected to the cabinet or rack by slide assemblies and one of the drawers is pulled out from the cabinet or rack, the rest of the drawers are locked by the rails and cannot be pulled out.

BACKGROUND OF THE INVENTION

A conventional cabinet with multiple drawers connected thereto by rails generally restricts the number of the drawers to be pulled out from the cabinet due to that the weight center of the pulled drawers may shift to outside of the cabinet so as to drag the cabinet to fall. Besides, the electric equipments such as servos that are connected to the cabinet by rails known as rack-mounted computer system, the servos can be pulled from the cabinet like the drawers so that the anti-tip or anti-tilt function is considered to be added to the system.

In order to improve the problem and meet the demands, the interlock device is developed to prevent the drawers from being pulled simultaneously. The prior art in this field is searched from the searching system of the United States Patent and Trademark Office by input the keywords "anti-tip", "anti-tilt" and "interlock" and including the term "drawer". The result involves tens of applications which mean that the development in this field is significant.

SUMMARY OF THE INVENTION

The present invention intends to provide an interlock device for a slide assembly, wherein the interlock device includes fewer parts and is easily assembled and includes good interlock function.

The present invention relates to an interlock device and comprises a slide assembly comprising an outer rail, an inner rail and an intermediate rail movably connected between the outer and inner rails. The outer rail has a sliding way and a support frame. An opening is defined in the support frame. An interlock is connected to a front end of the slide assembly and comprises a base fixed to the support frame and located corresponding to the opening. The base has a top portion and a bottom portion located corresponding to the top portion. The top portion and the bottom portion are respectively located on a top side and a bottom side of the sliding way of the outer rail. The top portion has a top room communicating with the sliding way of the outer rail, and the bottom portion has a bottom room communicating with the sliding way of the outer rail. A driving member is movably connected to the base and has a driving portion. An engaging portion is located corresponding to the driving portion. A co-moving portion is located between the driving portion and the engaging portion. The driving portion is located at a front end of the intermediate rail and in the top room. A part of the driving portion extends from the top room. The engaging portion is located in the bottom room of the base. The co-moving portion extends through the opening. When the inner rail and the intermediate rail are pulled out relative to the outer rail, the driving portion of the driving member is pushed by the intermediate rail and retracted into the top room of the base. The co-moving portion is moved from a first position to a second position, and the engaging portion extends from the bottom room of the base.

Preferably, the driving portion of the driving member has an inclined surface located corresponding the front end of the intermediate rail.

Preferably, a resilient member is located between the base and the driving member.

Preferably, a push member is fixed to the front end of the intermediate rail and has an inclined push surface which is located corresponding to the driving portion of the driving member.

Preferably, a lever is connected to the inner rail and has a push member located corresponding to the driving portion of the driving member.

Preferably, the lever includes a stop which is located corresponding to the engaging portion of the driving member.

Preferably, a stop is connected to one of the inner rail and the intermediate rail.

Preferably, the interlock device comprises a second slide assembly and a locking member, wherein the second slide assembly comprises a second outer rail, a second inner rail and a second intermediate rail movably connected between the second outer rail and the second inner rail. A second interlock device comprises a second base, a second driving member and a second stop. The second driving member is movably connected to the second base and comprises a second driving portion, a second engaging portion and a second co-moving portion. The second stop is connected to one of the second inner rail and the second intermediate rail. The locking member is connected to the co-moving portion of the driving member and the second co-moving portion of the second driving member. When the co-moving portion of the driving member is moved from the first position to the second position, the locking member is driven to move the second driving portion of the second interlock so that the second engaging portion of the second driving member stops the second stop to lock the second slide assembly.

Preferably, the locking member comprises multiple equally spaced holes, and the co-moving portion and the second co-moving portion are inserted into the holes.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
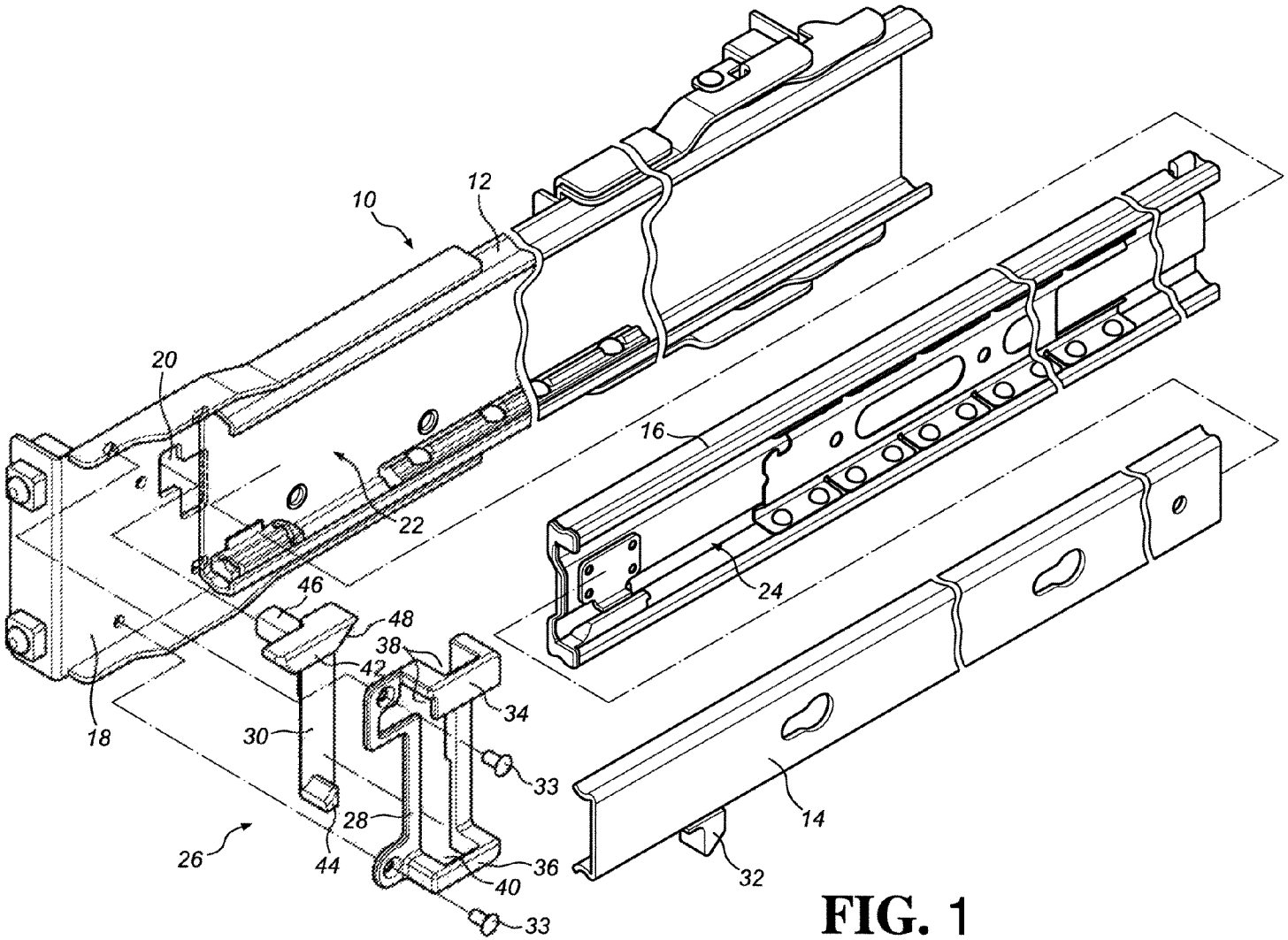
FIG. 1 is an exploded view to show the slide assembly and the interlock device according to a first embodiment of the present invention.
Figure 2:
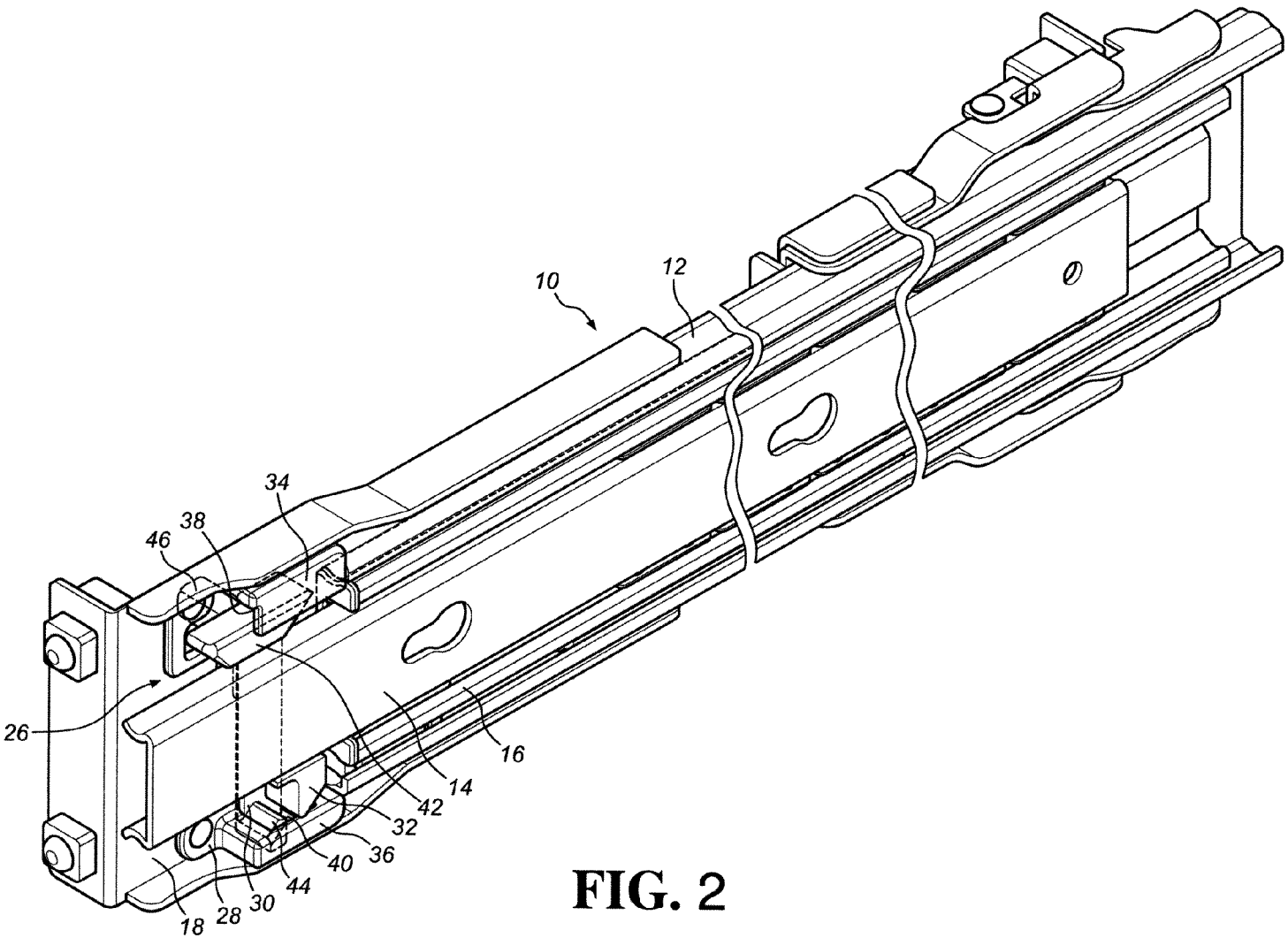
FIG. 2 is a perspective view to show the combination of the slide assembly and the interlock device according to the first embodiment of the present invention.

Referring to FIGS. 1 and 2, the first embodiment of the slide assembly 10 of the present invention comprises an outer rail 12, an inner rail 14 and an intermediate rail 16 movably connected between the outer and inner rails 12, 14. The outer rail 12 has a support frame 18 at one end thereof and an opening 20 is defined in the support frame 18. The outer rail 12 has a sliding way 22 so that the intermediate rail 16 is slidable in the sliding way 22. The intermediate rail 16 includes an intermediate way 24 and the inner rail 14 is slidable in the intermediate way 24. An interlock 26 is connected to a front end of the slide assembly 10.

As shown in the drawings, the interlock 26 comprises a base 28, a driving member 30 and a stop 32. The base 28 is fixed to the support frame 18 of the outer rail 12 by fixing members 33 such as rivets. The base 28 is located corresponding to the opening 20. The base 28 has a top portion 34 and a bottom portion 36 located corresponding to the top portion 34. The top portion 34 and the bottom portion 36 are respectively located on a top side and a bottom side of the sliding way 22 of the outer rail 12. The top portion 34 has a top room 38 communicating with the sliding way 22 of the outer rail 12, and the bottom portion 36 has a bottom room 40 communicating with the sliding way 22 of the outer rail 12.

The driving member 30 is movably connected to the base 28 and has a driving portion 42, an engaging portion 44 located corresponding to the driving portion 42, and a co-moving portion 46 located between the driving portion 42 and the engaging portion 44. The driving portion 42 is located at a front end of the intermediate rail 16 and in the top room 38. A part of the driving portion 42 extends from the top room 38. The engaging portion 44 is located in the bottom room 40 of the base 28. The driving portion 42 of the driving member 30 has an inclined surface 48 located corresponding to the front end of the intermediate rail 16. The co-moving portion 46 extends through the opening 20.

The stop 32 is connected to the bottom side of the inner rail 14 and located corresponding to the engaging portion 44 of the driving member 30.

Figure 3:
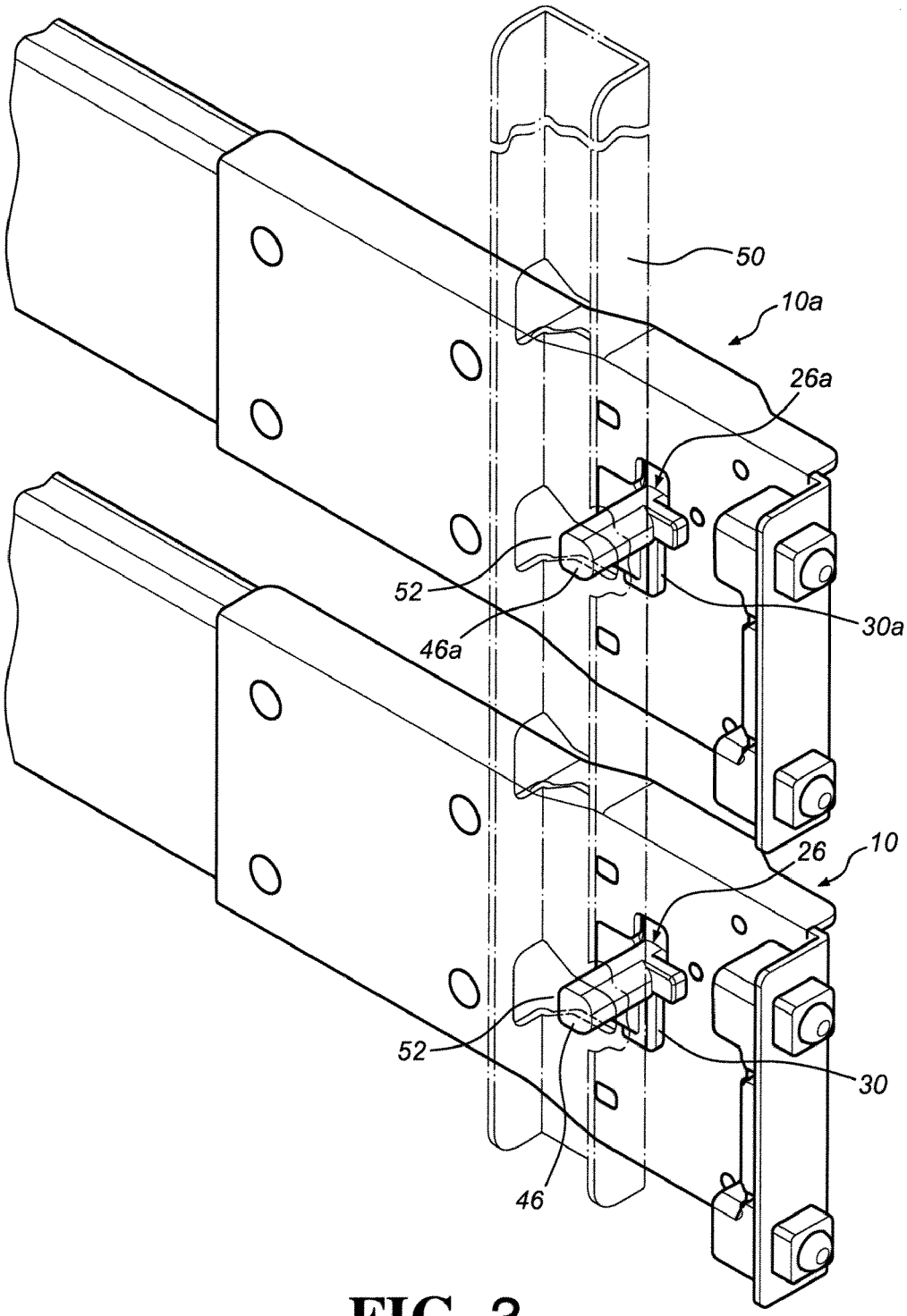
FIG. 3 is a perspective view to show the combination of two slide assemblies and the interlock devices according to the first embodiment of the present invention.

FIG. 3 shows that the present invention comprises at least one second slide assembly 10*a*. The second slide assembly 10*a* is connected with a second interlock 26*a* which is identical with the interlock 26. The second interlock 26*a* comprises a second driving member 30*a* having a second co-moving portion 46*a* located corresponding to the co-moving portion 46 of the interlock 26. A locking member 50 is connected to the co-moving portion 46 and the second co-moving portion 46*a*. The locking member 50 comprises multiple equally spaced holes 52, and the co-moving portion 46 and the second co-moving portion 46*a* are inserted into the holes 52. The slide assemblies and the interlock devices form a mutually related interlock assembly.

Figure 4:
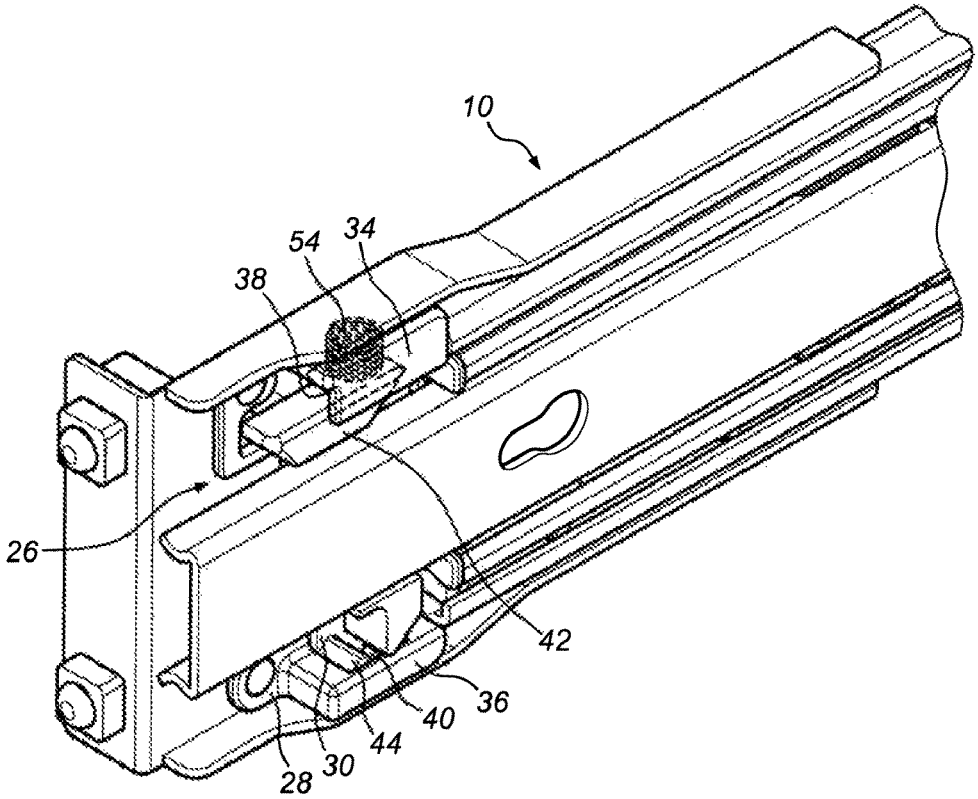
FIG. 4 shows that the interlock device of the present invention includes a resilient member according to the first embodiment of the present invention.

As shown in FIG. 4, taken the slide assembly 10 as the example, preferably, a resilient member 54 is located between the base 28 and the driving member 30 of the interlock 26. By the force from the resilient member 54, the driving member 30 is pushed and kept at a normal position and is able to return after being moved backward. The normal position is that a part of the driving portion 42 of the driving member 30 extends out from the top room 38 of the base 28, and the engaging portion 44 is retracted in the bottom room 40 of the base 28.

It is noted that the previous embodiments including multiple slide assemblies and interlock devices, taken the slide assembly 10 as an example, the driving member 30 can be normally lowered by the weight of the locking member 50 and the driving member 30 itself. Therefore, the driving portion 42 of the driving member 30 extends out from the top room 38 of the base 28, and the engaging portion 44 is retracted in the bottom room 40 of the base 28. Accordingly, under the status, the resilient member 54 can be omitted.

Figure 5:
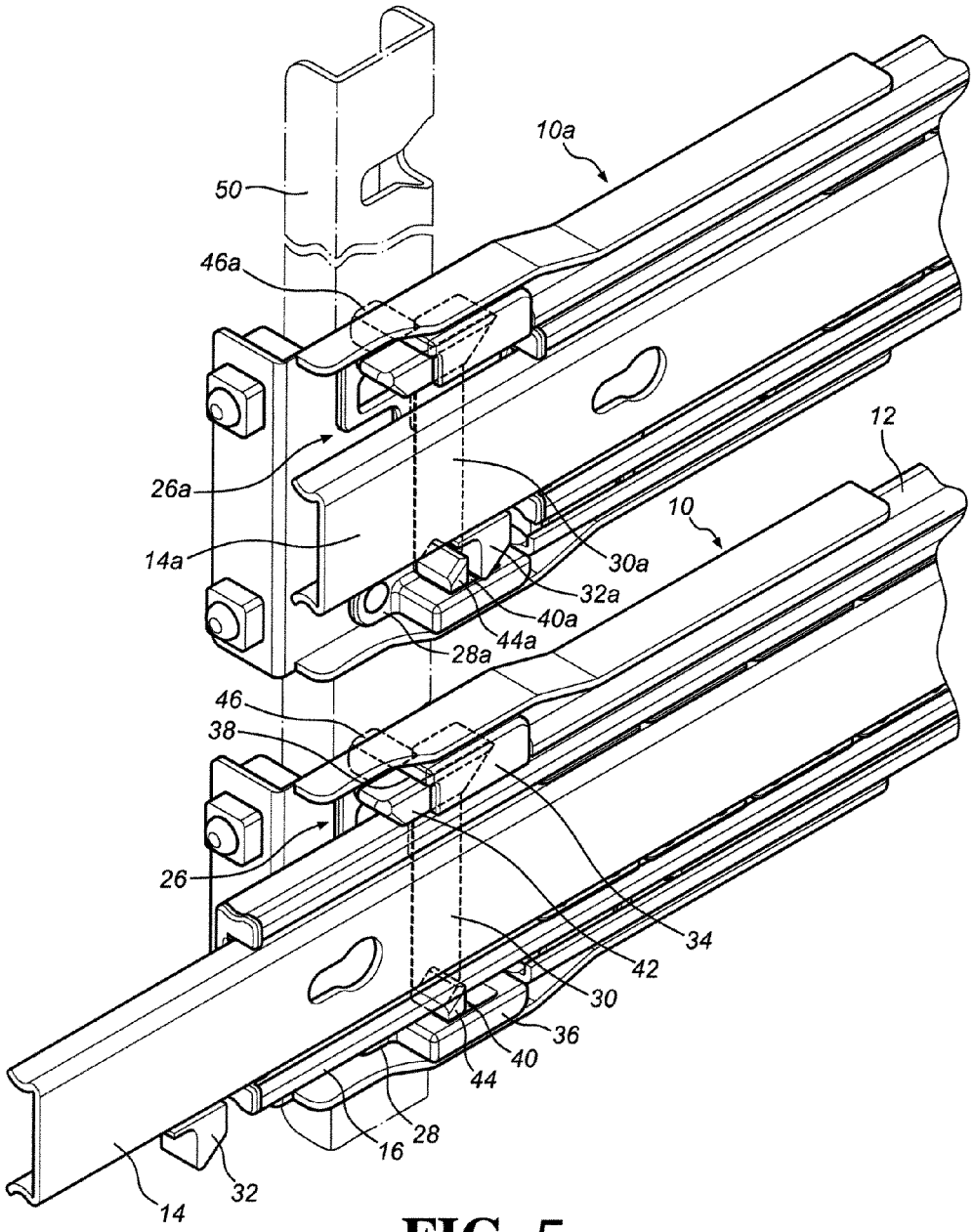
FIG. 5 is a perspective view to show that the inner rail of one of the two slide assemblies is pulled out and the slide assemblies are equipped with the interlock devices according to the first embodiment of the present invention.

When the inner rail 14 and the intermediate rail 16 of the slide assembly 10 are pulled out relative to the outer rail 12, preferably, the inner rail 14 and the intermediate rail 16 are moved simultaneously relative to the outer rail 12, the simultaneous movement device is known in the art and will not described in detail. As shown in FIG. 5, when the inner rail 14 and the intermediate rail 16 are simultaneously pulled out, the driving portion 42 of the driving member 30 of the interlock 26 is pushed by the front end of the intermediate rail 16 and retracted into the top room 38 of the base 28. In the meanwhile, the co-moving portion 46 of the driving member 30 is moved from a first position to a second position, and the locking member 50 is moved by the co-moving portion 46, and the second co-moving portion 46*a* of the second driving member 30*a* of the second interlock 26*a* is driven by the locking member 50, so that the second driving member 30*a* of the second interlock 26*a* is moved. Therefore, the second engaging portion 44*a* of the second driving member 30*a* extends from the bottom room 40*a* of the second base 28*a* and is located corresponding to the second stop 32*a* of the inner rail 14*a* of the second slide assembly 10*a*. The second engaging portion 44*a* stops the second stop 32*a*, and the movement of the inner rail 14*a* of the second slide assembly 10*a* is restricted to prevent the second slide assembly 10*a* from opening to achieve the purpose of safety use.

Figure 6:
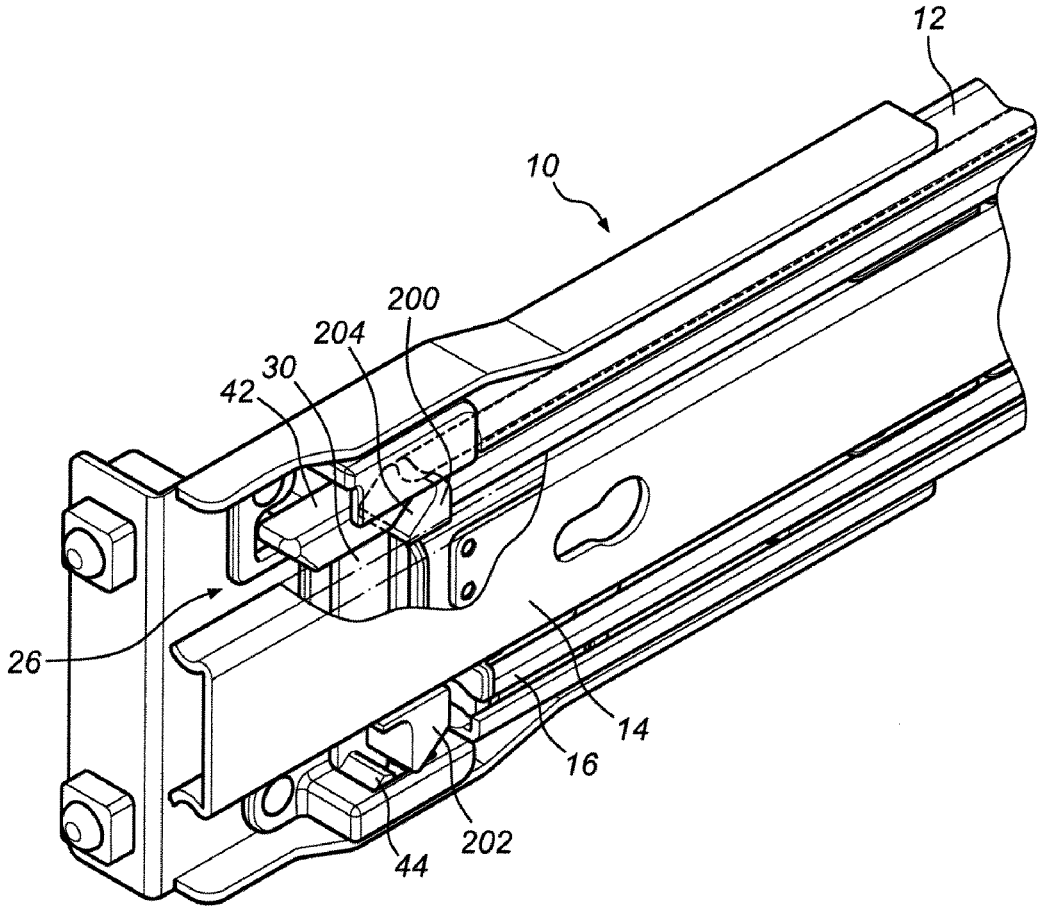
FIG. 6 is a perspective view to show the second embodiment of the interlock assembly of the present invention and the slide assembly.

As shown in FIG. 6, taken the slide assembly 10 as an example, the second embodiment of the present invention further comprises a push member 200 fixed to the front end of the intermediate rail 16 and a stop 202 connected to the inner rail 14 and located corresponding to the engaging portion 44. The push member 200 has an inclined push surface 204 which is located corresponding to the driving portion 42 of the driving member 30 of the interlock 26 so that the driving portion 42 of the driving member 30 is more easily pushed by the push surface 204 of the push member 200. When the intermediate rail 16 of the slide assembly 10 along with the inner rail 14 is pulled out relative to the outer rail 12, the driving portion 42 of the driving member 30 is first pushed by the push surface 204 of the push member 200 to activate the interlock device.

Figure 7:
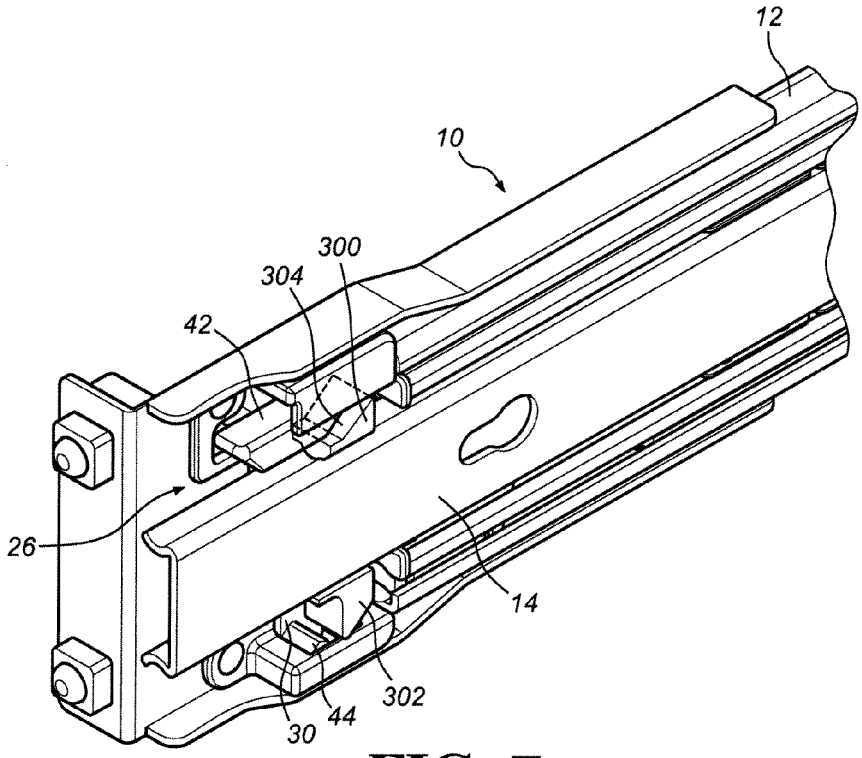
FIG. 7 is a perspective view to show the third embodiment of the interlock assembly of the present invention and the slide assembly.

As shown in FIG. 7, taken the slide assembly 10 as an example, the third embodiment of the present invention comprises a push member 300 fixed to the front end of the inner rail 14 and a stop 302 connected to the inner rail 14 and located corresponding to the engaging portion 44. The push member 300 has an inclined push surface 304 which is located corresponding to the driving portion 42 of the driving member 30 of the interlock 26, and this arrangement is helpful to allow the driving portion 42 of the driving member 30 pushed by the push surface 304 of the push member 300.

Figure 8:
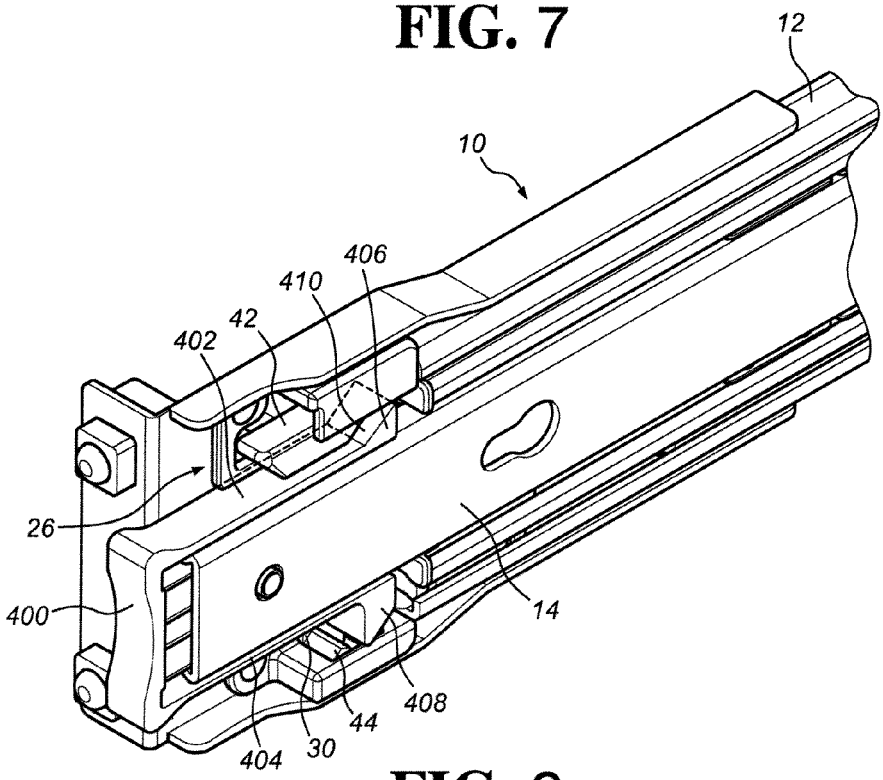
FIG. 8 is a perspective view to show the fourth embodiment of the interlock assembly of the present invention and the slide assembly.

As shown in FIG. 8, taken the slide assembly 10 as an example, the fourth embodiment of the present invention further comprises a lever 400 connected to the inner rail 14. The lever 400 includes a top side 402 and a bottom side 404 located corresponding to the top side 402, wherein the top side 402 has one end connected with has a push member 406 which is located corresponding to the driving portion 42 of the driving member 30 of the interlock 26. The bottom side 404 has one end connected to a stop 408 which is located corresponding to the engaging portion 44. Preferably, the push member 406 has an inclined push surface 410 located corresponding to the driving portion 42 of the driving member 30 of the interlock 26 so that the driving portion 42 of the driving member 30 is pushed by the push surface 410 of the push member 406.

Figure 9:
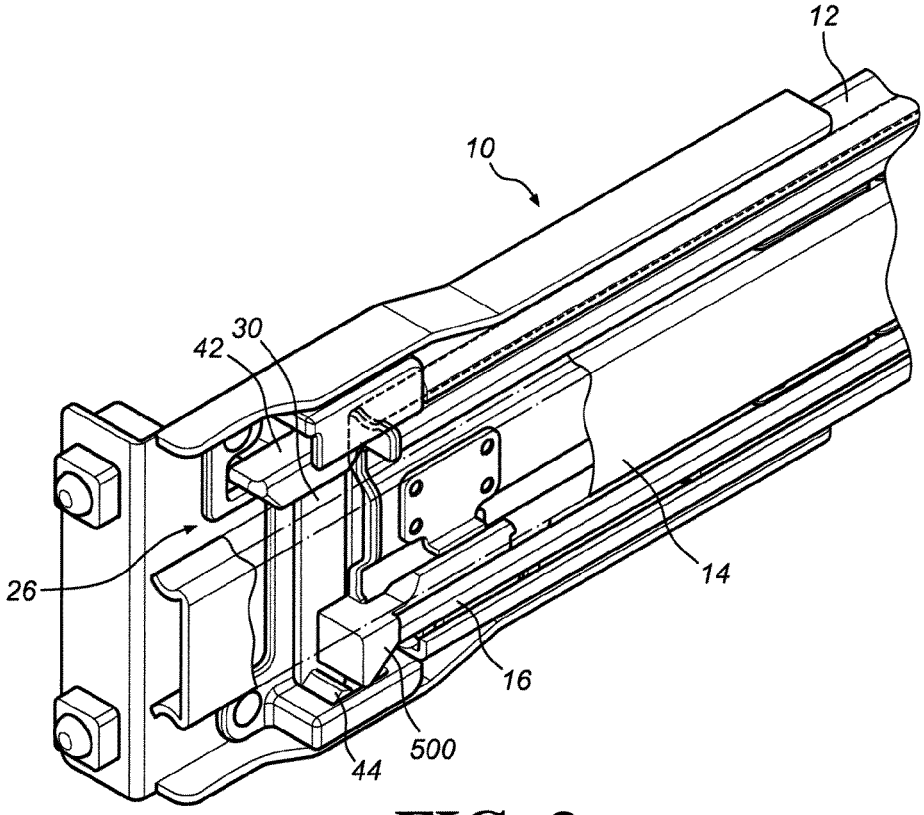
FIG. 9 is a perspective view to show the fifth embodiment of the interlock assembly of the present invention and the slide assembly.

Because the inner rail 14 and the intermediate rail 16 of the slide assembly 10 are simultaneously pulled out relative to the outer rail 12, if the intermediate rail 16 is locked, the inner rail 14 cannot be pulled out. Base on this, as shown in FIG. 9, the fifth embodiment of the present invention comprises a stop 500 fixed to the front end of the intermediate rail 16 and the stop 500 is located corresponding to the engaging portion 44 of the driving member 30 of the interlock 26. Therefore, when the stop 500 is stopped by the engaging portion 44 of the driving member 30 of the slide assembly 10, the intermediate rail 16 and the inner rail 14 are locked.

Figure 10:
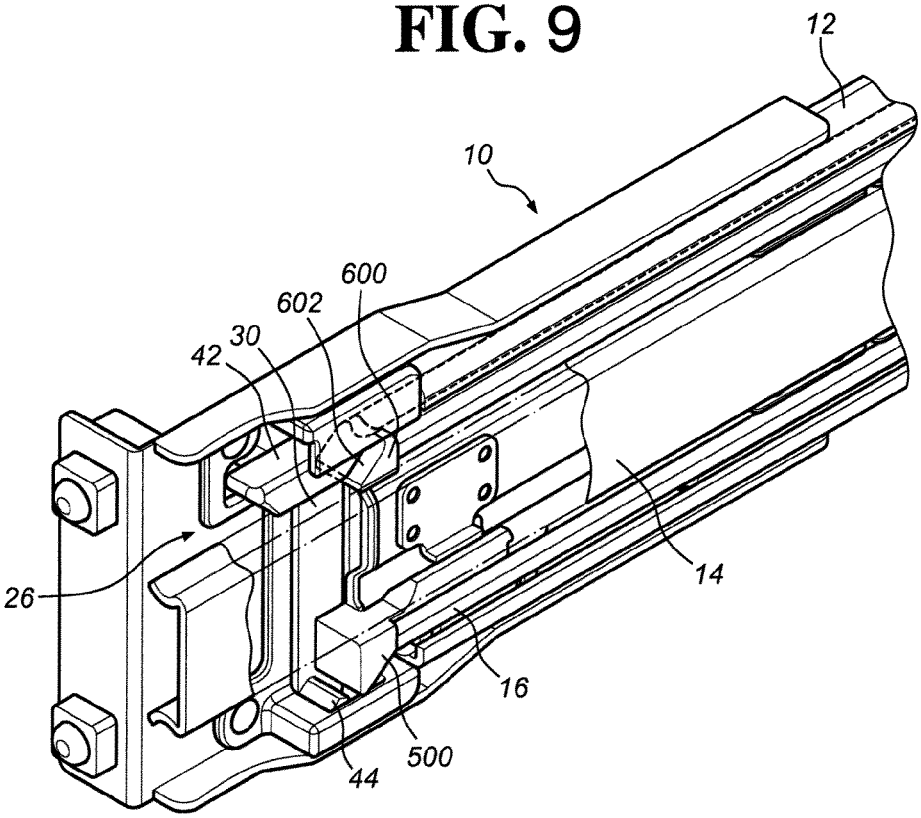
FIG. 10 is a perspective view to show the sixth embodiment of the interlock assembly of the present invention and the slide assembly.

As shown in FIG. 10, the sixth embodiment is followed by the fifth embodiment, except for having the stop 500 connected to the front end of the intermediate rail 16, further comprising a push member 600 fixed to the front end of the intermediate rail 16. The push member 600 is located corresponding to the driving portion 42 of the driving member 30 of the interlock 26. Preferably, the push member 600 has an inclined push surface 602 located corresponding to the driving portion 42 of the driving member 30 so that the driving portion 42 of the driving member 30 is pushed by the push surface 602 of the push member 600.

While we have shown and described the embodiment in accordance with the present invention, it should be clear to those skilled in the art that further embodiments may be made without departing from the scope of the present invention.

What is claimed is:

1. An interlock device, comprising:

a slide assembly comprising an outer rail, an inner rail and an intermediate rail movably connected between the outer and inner rails, the outer rail having a sliding way, the outer rail having a support frame and an opening defined in the support frame;

an interlock connected to a front end of the slide assembly, the interlock comprising:

a base fixed to the support frame and located corresponding to the opening, the base having a top portion and a bottom portion located corresponding to the top portion, the top portion and the bottom portion respectively located on a top side and a bottom side of the sliding way of the outer rail, the top portion having a top room communicating with the sliding way of the outer rail, the bottom portion having a bottom room communicating with the sliding way of the outer rail; and a driving member movably connected to the base and having a driving portion, an engaging portion located corresponding to the driving portion, and a co-moving portion located between the driving portion and the engaging portion, the driving portion located at a front end of the intermediate rail and in the top room, a part of the driving portion extending from the top room, the engaging portion located in the bottom room of the base, the co-moving portion extending through the opening;

wherein when the inner rail and the intermediate rail are pulled out relative to the outer rail, the driving portion of the driving member is pushed by the intermediate rail and retracted into the top room of the base, the co-moving portion is moved from a first position to a second position, and the engaging portion extends from the bottom room of the base.

2. The interlock device as claimed in claim 1, wherein the driving portion of the driving member has an inclined surface located corresponding to the front end of the intermediate rail.

3. The interlock device as claimed in claim 1, further comprising a resilient member located between the base and the driving member.

4. The interlock device as claimed in claim 1, further comprising a push member fixed to the front end of the intermediate rail, the push member having an inclined push surface which is located corresponding to the driving portion of the driving member.

5. The interlock device as claimed in claim 1, further comprising a lever connected to the inner rail, the lever having a push member located corresponding to the driving portion of the driving member.

6. The interlock device as claimed in claim 5, wherein the lever includes a stop which is located corresponding to the engaging portion of the driving member.

7. The interlock device as claimed in claim 1, further comprising a stop connected to one of the inner rail and the intermediate rail.

8. The interlock device as claimed in claim 7, further comprising a second slide assembly and a locking member, the second slide assembly comprising a second outer rail, a second inner rail and a second intermediate rail movably connected between the second outer rail and the second inner rail, a second interlock comprising a second base, a second driving member and a second stop, the second driving member being movably connected to the second base and comprising a second driving portion, a second engaging portion and a second co-moving portion, the second stop being connected to one of the second inner rail and the second intermediate rail, the locking member being connected to the co-moving portion of the driving member and the second co-moving portion of the second driving member, wherein when the co-moving portion of the driving member is moved from the first position to the second position, the locking member is driven to move the second driving portion of the second interlock so that the second engaging portion of the second driving member stops the second stop to lock the second slide assembly.

9. The interlock device as claimed in claim 8, wherein the locking member comprises multiple equally spaced holes and the co-moving portion and the second co-moving portion are inserted into the holes.

* * * * *